US007581496B2

(12) United States Patent
Hennings et al.

(10) Patent No.: US 7,581,496 B2
(45) Date of Patent: Sep. 1, 2009

(54) EXPLODING FOIL INITIATOR CHIP WITH NON-PLANAR SWITCHING CAPABILITIES

(75) Inventors: George N. Hennings, Ridgecrest, CA (US); Edwin J. Wild, Niceville, FL (US); Bradley L. Hanna, King George, VA (US); Christopher J. Nance, Middletown, CA (US); Richard K. Reynolds, Calistoga, CA (US)

(73) Assignee: Reynolds Systems, Inc., Middletown, CA (US)

( * ) Notice: Subject to any disclaimer, the term of this patent is extended or adjusted under 35 U.S.C. 154(b) by 0 days.

(21) Appl. No.: 11/828,032

(22) Filed: Jul. 25, 2007

(65) Prior Publication Data

US 2008/0148982 A1 Jun. 26, 2008

Related U.S. Application Data

(60) Provisional application No. 60/852,108, filed on Oct. 16, 2006.

(51) Int. Cl.
*F42B 3/10* (2006.01)

(52) U.S. Cl. ..... 102/202.7; 102/202.5; 102/202.9

(58) Field of Classification Search ..... 102/202.5, 102/202.7, 202.9, 202.14
See application file for complete search history.

(56) References Cited

U.S. PATENT DOCUMENTS 6,234,081 B1 * 5/2001 Neyer ..... 102/202.5
6,470,802 B1 * 10/2002 Neyer et al. ..... 102/202.5
6,810,815 B2 * 11/2004 Mueller-Fiedler et al. ..... 102/202.5
6,851,370 B2 * 2/2005 Reynolds et al. ..... 102/202.8
6,923,122 B2 8/2005 Hennings et al.
2003/0200890 A1 * 10/2003 Reynolds et al. ..... 102/202.5
2004/0086114 A1 5/2004 Rarick
2007/0261584 A1 * 11/2007 Nance et al. ..... 102/202.8

OTHER PUBLICATIONS

U.S. Appl. No. 11/430,944, filed May 9, 2006, Christopher J. Nance.
U.S. Appl. No. 11/431,111, filed May 9, 2006, Nance et al.
U.S. Appl. No. 11/541,998, filed Sep. 29, 2006, Christopher J. Nance.

* cited by examiner

*Primary Examiner*—Michael Carone
*Assistant Examiner*—Samir Abdosh
(74) *Attorney, Agent, or Firm*—Harness, Dickey & Pierce, P.L.C.

(57) ABSTRACT

An initiator that includes a substrate, an exploding foil initiator and a first switch. The exploding foil initiator coupled to the substrate and includes a bridge and a first bridge contact. The first switch has a first contact and a first insulator. The first contact is coupled to the substrate and spaced apart from the first bridge contact by a gap. The first insulator is disposed in the gap. The first switch is operable in an actuated mode in which electrical energy transmitted between the first contact and the first bridge contact is transmitted through the first insulator.

20 Claims, 6 Drawing Sheets

EXPLODING FOIL INITIATOR CHIP WITH NON-PLANAR SWITCHING CAPABILITIES

CROSS REFERENCE TO RELATED APPLICATIONS

This application claims the benefit of U.S. Provisional Patent Application Ser. No. 60/852,108 filed Oct. 16, 2006, the disclosure of which is hereby incorporated by reference as if fully set forth in detail herein.

INTRODUCTION

The present disclosure generally relates to detonators and initiation firesets (hereinafter referred to as "initiators") for initiating an event, such as a combustion, deflagration or detonation event, in an associated charge and more particularly to an exploding foil initiator chip having integrated switching capabilities to provide multiple mode functionality.

Initiators utilizing exploding foil initiator (EFI) chips are well known in the art. Briefly, (EFI) chips include a substrate chip (typically a ceramic) onto which a bridge is mounted. The bridge is connected to a power source through two conductive lands or pads or in the alternative a low inductance connection. In a system wherein operation of the exploding foil initiator is initiated by an external trigger (i.e., standard mode operation), the power source can typically be a capacitor whose discharge is governed by a high voltage switch. When the switch closes, the capacitor provides sufficient electric current to convert the bridge from a solid state to a plasma. The pressure of the plasma drives a flyer into contact with an explosive charge, thereby generating a shock wave that can be employed to initiate a desired event (e.g., detonation, deflagration or combustion).

Where one or more other modes of operation are desired, it is known in the art to couple the bridge to one or more discrete switch devices. While the discrete switch devices are effective for their intended purpose, it is understood in the art that such discrete switch devices can be both costly and difficult to package into a desired application due to their relative weight, size and spacing.

Accordingly, it would be desirable to provide an initiator having multiple mode triggering functionality in manner that is relatively inexpensive, lightweight and compact.

SUMMARY

In one form, the present teachings provide an initiator that includes a substrate, an exploding foil initiator and a first switch. The exploding foil initiator coupled to the substrate and includes a conductive bridge and a first bridge contact. The first switch has a first contact and a first insulator. The first contact is coupled to the substrate and spaced apart from the first bridge contact by a gap. The first insulator is disposed in the gap. The first switch is operable in an actuated mode in which electrical energy transmitted between the first contact and the first bridge contact is transmitted through the first insulator.

In another form, the present teachings provide a method that includes: providing an initiator having an exploding foil initiator and a first switch, the exploding foil initiator including a substrate and a bridge that is coupled to the substrate, the bridge including a first bridge contact, the switch including a first contact, which is spaced apart from the first bridge contact by a predetermined distance, and a first insulator that is received in the first gap; applying electrical energy to the first contact; and directing electrical energy from the first contact through the first insulator to the first bridge contact to thereby actuate the exploding foil initiator.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The drawings described herein are for illustration purposes only and are not intended to limit the scope of the present disclosure in any way.

DETAILED DESCRIPTION OF THE VARIOUS EMBODIMENTS

Figure 1:
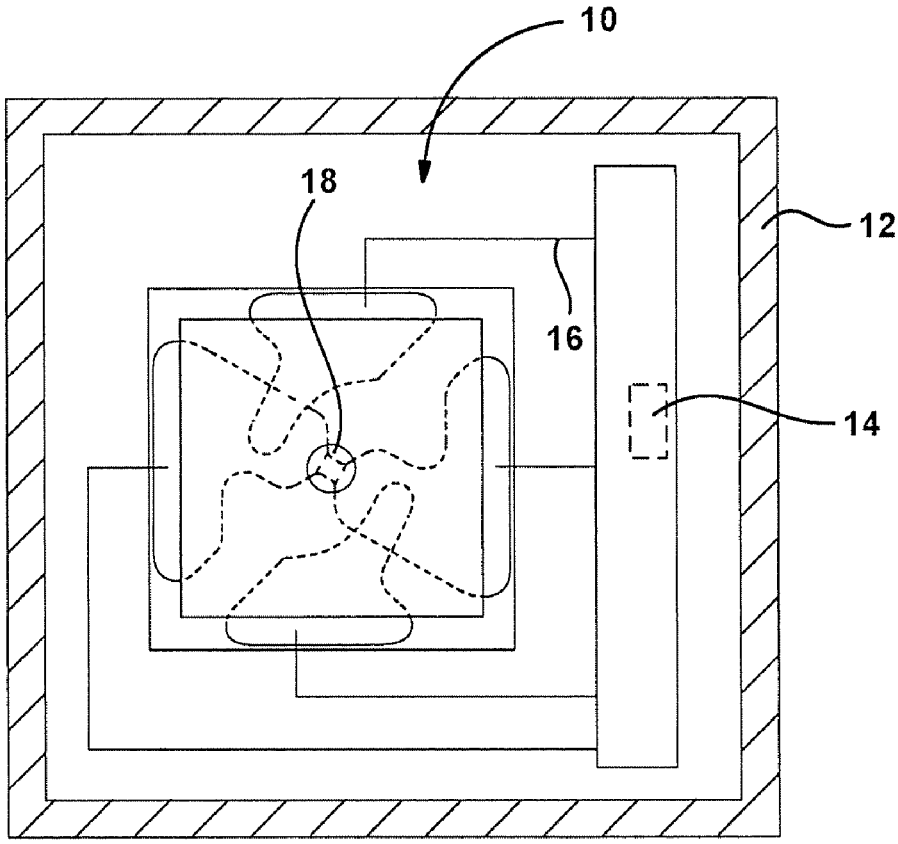
FIG. 1 is a schematic plan view of a detonator constructed in accordance with the teachings of the present disclosure.

With reference to FIG. 1 of the drawings, an initiator constructed in accordance with the teachings of the present invention is generally indicated by reference numeral 10. The initiator 10 can be housed in a hermetically-sealed housing 12 and can be selectively coupled to a source of electrical energy 14 via a plurality of leads or terminals 16. The initiator 10 can be employed to initiate a detonation event in an appropriate energetic material 18, such as a primary explosive (e.g., mercury fulminate, lead styphnate or lead azide) or a secondary explosive (e.g., pentaerythritol tetranitrate (PETN), cyclotrimethylenetrinitramine (RDX), trinitrotoluene (TNT) or hexanitro stilbene (HNS), RSI-007, which is available from Reynolds Systems, Inc. of Middletown, Calif.).

Figure 2:
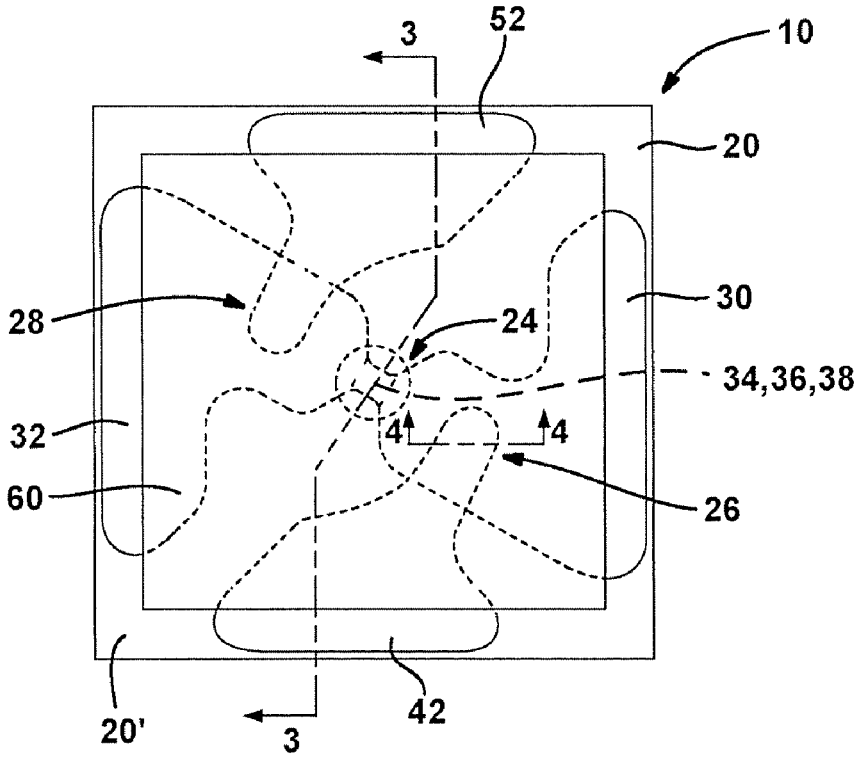
FIG. 2 is a top plan view of the initiator of FIG. 1.

With additional reference to FIG. 2, the initiator 10 can include a substrate 20, an exploding foil initiator 24, a first switch 26 and a second switch 28. The substrate 20 can be formed of an electrically insulating material, such as ceramic, glass, polyimide or silicon, and can define a surface 20' onto which other components of the initiator 10 can be layered.

Figure 3:
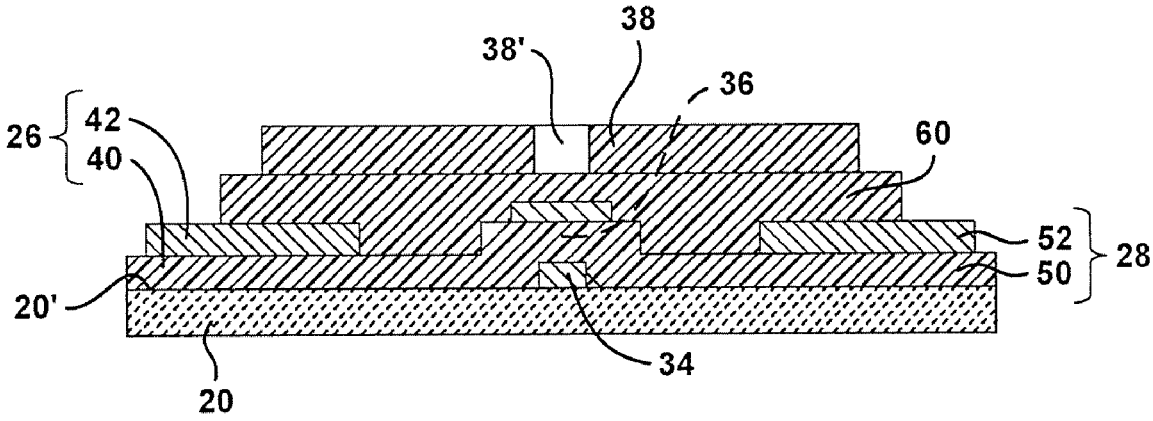
FIG. 3 is a sectional view taken along the line 3-3 of FIG. 2.
Figure 4:
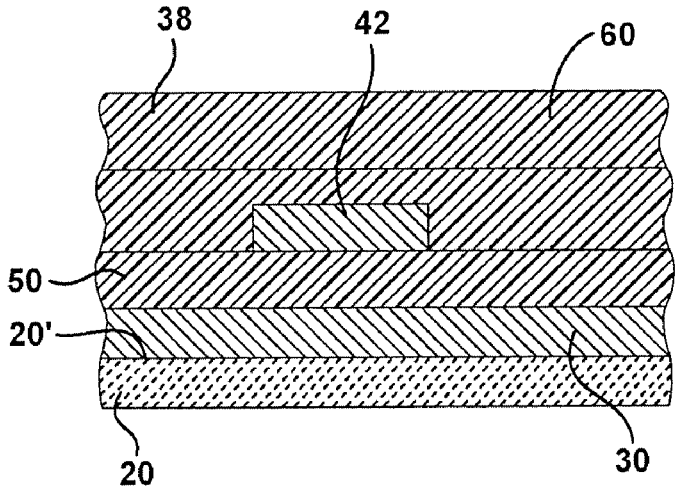
FIG. 4 is a sectional view taken along the line 4-4 of FIG. 2.

With reference to FIGS. 2 through 4, the exploding foil initiator 24 can include a first bridge contact 30, a second bridge contact 32, a bridge 34, a flyer 36, and a barrel 38. The first and second bridge contacts 30 and 32 and the bridge 34 can be formed of an electrically conductive material, such as but not limited to nickel, copper, gold, silver, aluminum and alloys thereof, and can be formed by one or more discrete layers of material. The first and second bridge contacts 30 and 32 and the bridge 34 can be fixedly coupled to the surface 20' of the substrate 20 via any appropriate process, such as metallization. The flyer 36 can be formed of an electrically insulating material, such as polyimide, and can be located in-line with the bridge 34. The barrel 38 can be formed of an electrically insulating material, such as a polyimide film, can be coupled to the substrate 20 and can define a barrel aperture 38' that can be disposed in-line with both the flyer 36 and the bridge 34. As will be appreciated by those of ordinary skill in the art, the barrel aperture 38' provides a path along which the flyer 36 may be directed toward an energetic material 18 (FIG. 1) to initiate a reaction in the energetic material.

The first switch 26 can include a first insulator 40 and a first switch terminal 42. The first insulator 40 can be formed of an appropriate electrically insulating material, such as polyimide, and can be layered or bonded onto the first bridge contact 30. The first switch terminal 42 can be formed of an electrically conductive material, such as but not limited to nickel, copper, gold, silver, aluminum and alloys thereof and can be formed by one or more discrete layers of material. The first switch terminal 42 can be fixedly coupled to the first insulator 40 on a side thereof opposite the first bridge contact 30. The first switch terminal 42 can be formed in any appropriate process, such as metallization.

Similarly, the second switch 28 can include a second insulator 50 and a second switch terminal 52. The second insulator 50 can be formed of an appropriate electrically insulating material, such as polyimide, and can be layered or bonded onto the second bridge contact 32. The second switch terminal 52 can be formed of an electrically conductive material, such as but not limited to nickel, copper, gold, silver, aluminum and alloys thereof and can be formed by one or more discrete layers of material. The second switch terminal 52 can be fixedly coupled to the second insulator 50 on a side thereof opposite the second bridge contact 32. The second switch terminal 52 can be formed in any appropriate process, such as metallization.

As will be appreciated, the initiator 10 can be operated in several different modes, including a standard mode, a first breakdown mode, and a second breakdown mode.

Operation of the initiator 10 in the standard mode can entail the transmission of electrical energy from an appropriate source of electrical energy 14 (FIG. 1) to the first bridge contact 30, through the bridge 34 to the second bridge contact 32 and thereafter to an electrical ground. Operation of the initiator 10 in the standard mode may be initiated through an external trigger to thereby electrically couple the bridge 34 to the energy source, which can be a capacitor (not shown) whose discharge is governed by a high voltage switch (not shown). Energy transmitted from the energy source to the bridge 34 is employed to convert the bridge 34 from a solid state to a plasma state. The transformation of the bridge 34 to a plasma state generates pressure that is sufficient to propel the flyer 36 and strike the flyer 36 through the barrel 38 so that it may impact an energetic material 18 (FIG. 1) and generate a shock wave within the energetic material to initiate a desired reaction. It will be appreciated that no energy is transmitted through the first or second switches 26 and 28 when the initiator 10 is operated in the standard mode.

In the first breakdown mode the second bridge contact 32 can be coupled to an electrical ground, while the first switch terminal 42 can be coupled to a source of electrical energy. Electricity can be transmitted through the first insulator 40 in a direction that can be generally perpendicular to the surface 20' of the substrate 20 when a sufficiently large electric potential is applied to the first switch terminal 42 to thereby supply energy to the bridge 34. It will be appreciated that the electricity may or may not follow a path through the first insulator 40 that is generally perpendicular to the surface 20' of the substrate 20 but rather that the electricity can pass vertically through the layers that are deposited onto the surface 20'.

In the second breakdown mode the first bridge contact 30 can be coupled to an electrical ground, while the second switch terminal 52 can be coupled to a source of electrical energy. Electricity can be transmitted through the second insulator 50 in a direction that can be generally perpendicular to the surface 20' of the substrate 20 when a sufficiently large electric potential is applied to the second switch terminal 52 to thereby supply energy to the bridge 34. It will be appreciated that the electricity may or may not follow a path through the second insulator 50 that is generally perpendicular to the surface 20' of the substrate 20 but rather that the electricity can pass vertically through the layers that are deposited onto the surface 20'.

In some instances it can be desirable for the first and second switches 26 and 28 to be identically configured. It may be desirable in other situations to configure the first and second switches 26 and 28 differently from one another. For example, the first and second insulators 40 and 50 can be formed of the same insulating material but have different thicknesses so that the magnitude of the electric potential that is needed to pass energy through the first switch 26 is different from the magnitude of the electric potential that is needed to pass energy through the second switch 28.

As those of ordinary skill in the art will appreciate from this disclosure, the transmission of electrical energy between a switch (e.g., the first switch 26) and an associated bridge contact (e.g., the first bridge contact 30) in a vertical direction through one or more dielectric layers has numerous advantages. For example, an initiator constructed in accordance with the teachings of the present disclosure can have significant levels of functionality (e.g., switching modes) while being packaged in a relatively small volume. Furthermore, as the various terminals and contacts can be sealed between one or more layers of an insulating material, the switches are not affected by foreign particles. Moreover, the insulation of the terminals and contacts can facilitate the transmission of energy having a relatively high electric potential while the terminals and contacts are in relatively close proximity without concern that the electric energy will be inadvertently misdirected (i.e., jump) between the terminals and/or switches.

With reference to FIGS. 2 and 5 through 7, a process for forming an initiator 10 in accordance with the teachings of the present disclosure is provided. With specific reference to FIG. 5, the first and second bridge contacts 30 and 32 and the bridge 34 can be coupled to the surface 24 of the substrate 20 to form a first subassembly 100. A first mask (not shown) can be employed to define a first predetermined area over which the first and second bridge contacts 30 and 32 and the bridge 34 extend. The first and second bridge contacts 30 and 32 and the bridge 34 can be applied to this predefined area in a desired manner, such as through metallization. Alternatively, one or more layers of metal may be applied to the surface 20' of the substrate 20, a first mask (not shown) may be employed to apply a "resist" to the layer of metal and the portions of the layer of metal that are not coated by the resist may be removed in an etching process in a manner that is similar to the formation of a printed circuit board. The resist may be subsequently removed or may be employed to form the first layer of insulating material 102 (FIG. 6) described below.

Figure 5:
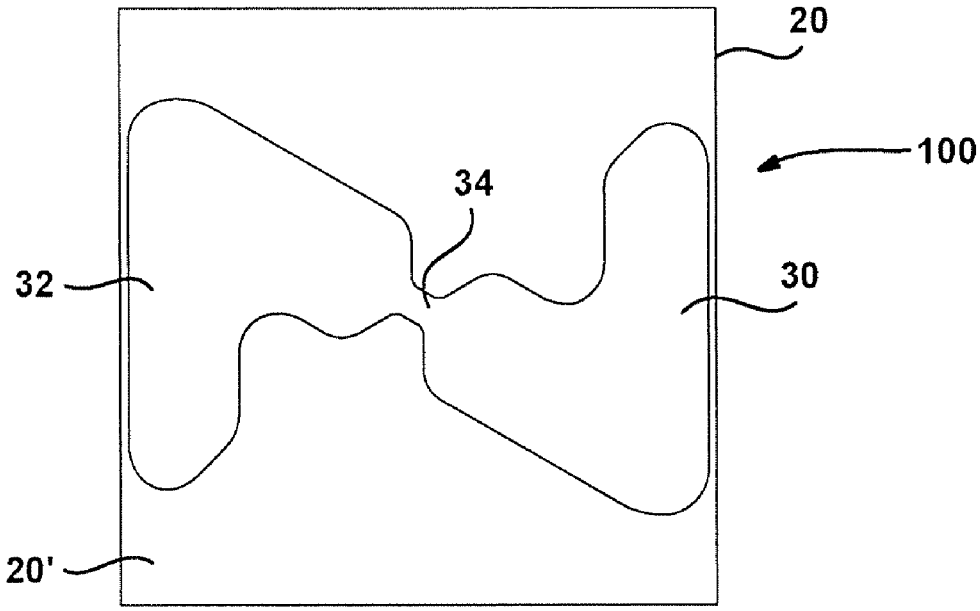
FIGS. 5 through 8 are a top plan views of portions of the initiator of FIG. 1 illustrating a process for fabricating an initiator in accordance with the teachings of the present disclosure.
Figure 6:
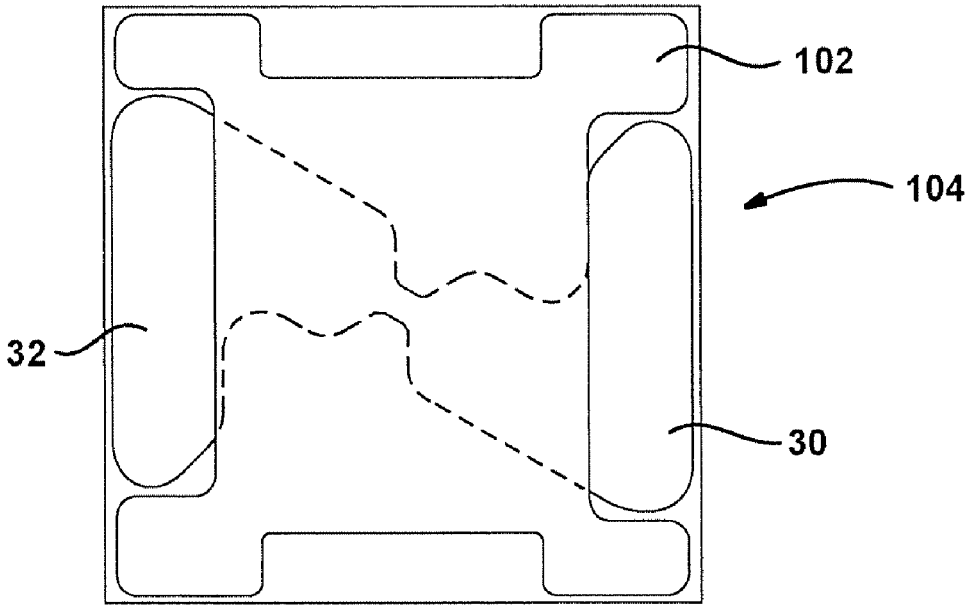

With specific reference to FIG. 6, a first layer of insulating material 102 can be applied to a second predefined area over a desired portion of the first subassembly 100 (FIG. 5) to thereby form a second subassembly 104. In the particular example provided, portions of the first and second bridge contacts 30 and 32 are not covered to facilitate the electrical connection of the exploding foil initiator 24 (FIG. 2) to one or more external devices (not shown). A mask (not shown) of the type that is employed in the formation of a printed circuit board can be employed to control the deposition of insulating material onto the first subassembly 100 (FIG. 5).

Figure 7:
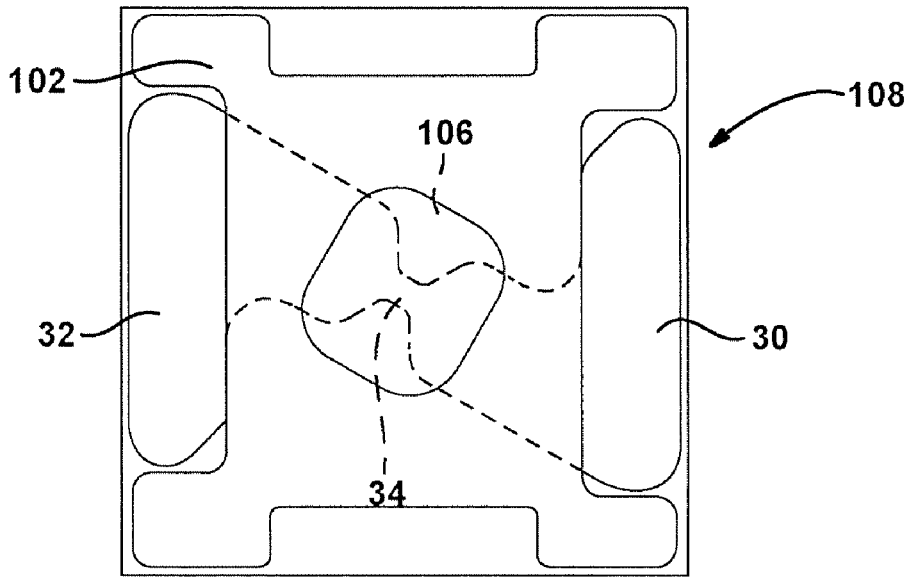

With specific reference to FIG. 7, a second layer of insulating material 106 can be applied to a third predefined area over a desired portion of the second subassembly 104 (FIG. 6) to thereby form a third subassembly 108. In the particular example provided the flyer 36 (FIG. 2) is relatively thicker than the first and second insulators 40 and 50 (FIG. 3) and as such, the insulating material 106 is deposited over the bridge 34 to ensure that the flyer 36 (FIG. 2) is formed to a desired thickness. A mask (not shown) of the type that is employed in the formation of a printed circuit board can be employed to control the deposition of insulating material onto the second subassembly 104 (FIG. 6).

Figure 8:
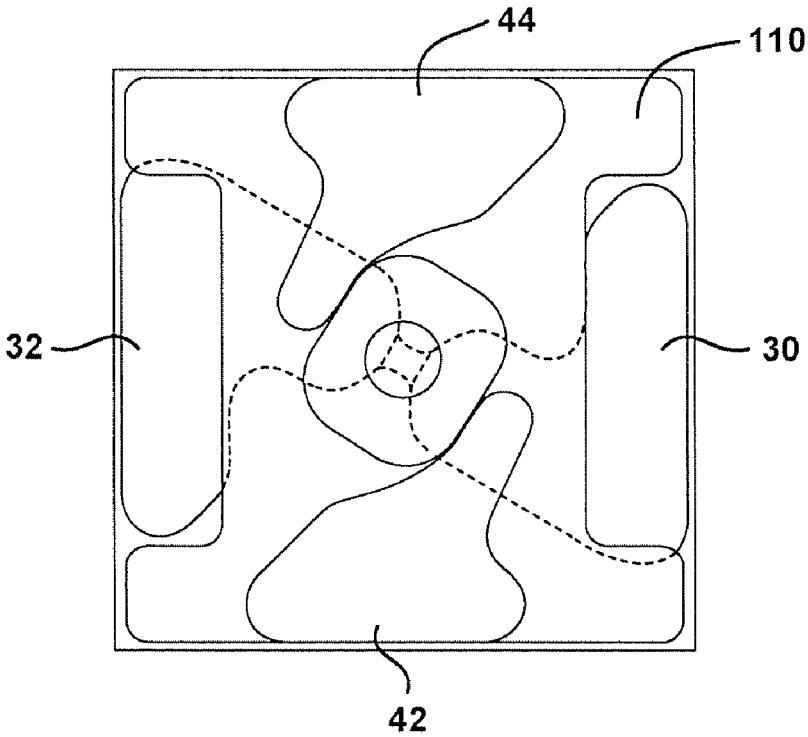

With specific reference to FIG. 8, the first and second switch terminals 42 and 52 can be coupled to the third subassembly 108 (FIG. 7) to thereby form a fourth subassembly 110. A mask (not shown) can be employed to define a fourth predetermined area over which various elements, including the first and second switch terminals 42 and 52 are to extend. The first and second switch terminals 42 and 52 can be applied to this predefined area in a desired manner, such as through metallization. Alternatively, one or more layers of metal may be applied over the third subassembly 108 (FIG. 7), a mask (not shown) may be employed to apply a "resist" to the layer of metal and the portions of the layer of metal that are not coated by the resist may be removed in an etching process in a manner that is similar to the formation of a printed circuit board. The resist may be subsequently removed or may be employed to form the third layer of insulating material 60 described below.

With reference to FIG. 2, a third layer of insulating material 60 can be applied to a fifth predetermined area to thereby cover portions of the first and second switch terminals 42 and 52. In the particular example provided, portions of the first and second bridge contacts 30 and 32 and the first and second switch terminals 42 and 52 are not covered to facilitate the electrical connection of the exploding foil initiator 24, the first switch 26 and/or the second switch 28 to one or more external devices (not shown). A mask (not shown) of the type that is employed in the formation of a printed circuit board can be employed to control the deposition of insulating material onto the fifth subassembly. It will be appreciated that each of the above-described layers of insulating materials may be deposited in one or more discrete layers (i.e., sub-layers) and that the individual layers need not be of equal thicknesses. Moreover, while the individual layers are formed of the same material in the particular example provided, it will be appreciated that one or more of the individual layers (or sub-layers) may be formed of a material that differs from another of the individual layers (or sub-layers).

Figure 9:
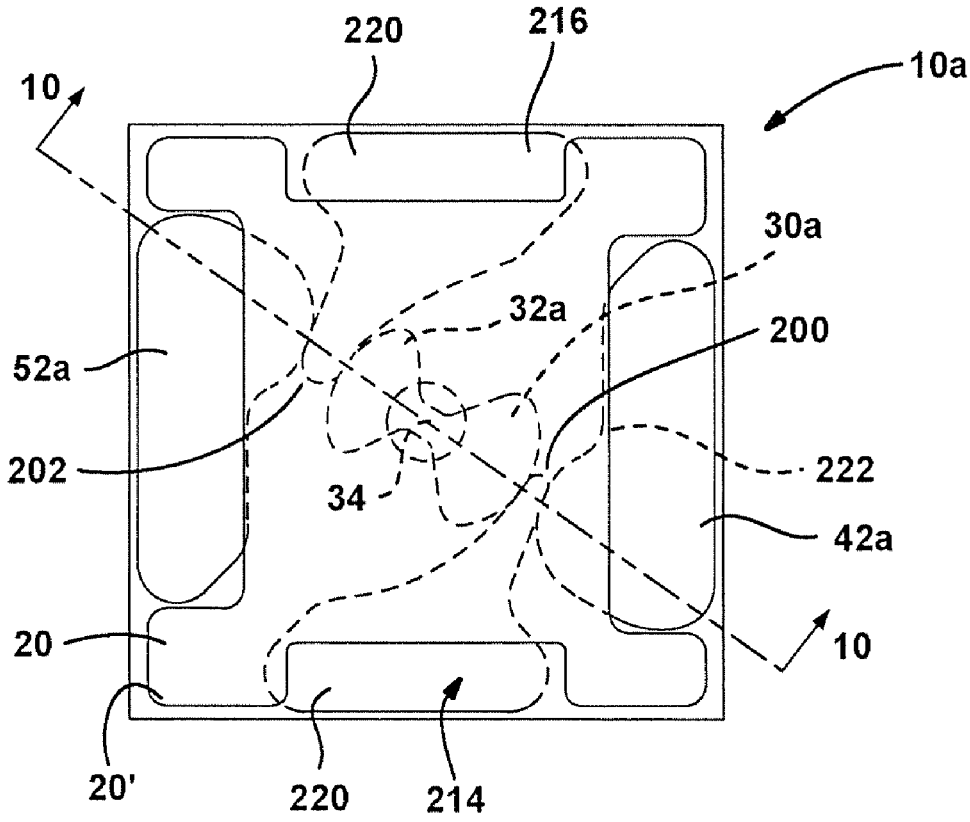
FIG. 9 is a top plan view of a second initiator constructed in accordance with the teachings of the present disclosure.

With reference to FIGS. 8 and 9, a second initiator constructed in accordance with the teachings of the present disclosure is generally indicated by reference numeral 10*a*. The initiator 10*a* can be generally similar to the initiator 10 of FIG. 1 except as noted below. The first switch terminal 42*a* can be mounted onto the surface 20' of the substrate 20 and can be spaced apart from the first bridge contact 30*a* by a first gap 200. Similarly, the second switch terminal 52*a* can be mounted onto the surface 20' of the substrate 20 and can be spaced apart from the second bridge contact 32*a* by a second gap 202. One or more layers of insulation 210 can be applied over the first and second bridge contacts 30*a* and 32*a*, the bridge 34 and the first and second switch terminals 42*a* and 52*a* such that the insulation 210 can be received in the first and second gaps 200 and 202. First and second trigger contacts 214 and 216, respectively, can be layered over the insulation 210. In the example provided the first and second trigger contacts 214 and 216 are generally similar and as such, only the first trigger contact 214 will be discussed in detail herein. The first trigger contact 214 can include a terminal portion 220, which can be adapted to be coupled to a source of electrical energy (not shown) and a projection 222. The projection 222 can extend from the terminal portion 220 and can overlie the insulation 210 over the first gap 200. Optionally, the projection 222 can also overlie portions of the first bridge contact 30*a* and/or the first switch terminal 42*a*.

In operation, the initiator 10*a* can be employed in a breakdown mode or a trigger mode. In the breakdown mode, the second bridge contact 32*a* can be electrically coupled to an electrical ground and the first switch terminal 42*a* can be electrically coupled to a source of electric power having an electric potential that is sufficient to transmit electric energy through the insulation 210 that is disposed in the first gap 200.

In the trigger mode, the second bridge contact 32*a* can be electrically coupled to an electrical ground, the first switch terminal 42*a* can be electrically coupled to a source of electric power having an electric potential that is not sufficient (by itself) to transmit electric energy through the insulation 210 that is disposed in the first gap 200, and the terminal portion 220 of the first trigger contact 214 can be selectively coupled to a voltage source. Application of electric power to the terminal portion 220 can affect the field about the first gap 200 to effectively lower the electric potential that is necessary to cause energy to be transmitted through the insulation 210 and across the first gap 200 (i.e., so that the electric potential of the energy applied to the first switch terminal 42*a* is sufficient to transmit electric energy through the insulation 210 and across the first gap 200).

In an alternative trigger mode, the second bridge contact 32*a* can be electrically coupled to an electrical ground, the first switch terminal 42*a* can be electrically coupled to a source of electric power having an electric potential that is not sufficient (by itself) to transmit electric energy through the insulation 210 that is disposed in the first and second gaps 200 and 202, and the terminal portion 220 of the second trigger contact 216 can be selectively coupled to a voltage source. Application of electric power to the terminal portion 220 of the second trigger contact 216 can affect the field about the second gap 202 to effectively lower the electric potential that is necessary to cause energy to be transmitted through the insulation 210 and across the first and second gaps 200 and 202 (i.e., so that the electric potential of the energy applied to the first switch terminal 42*a* is sufficient to transmit electric energy through the insulation 210 and across the first and second gaps 200 and 202).

Figure 10:
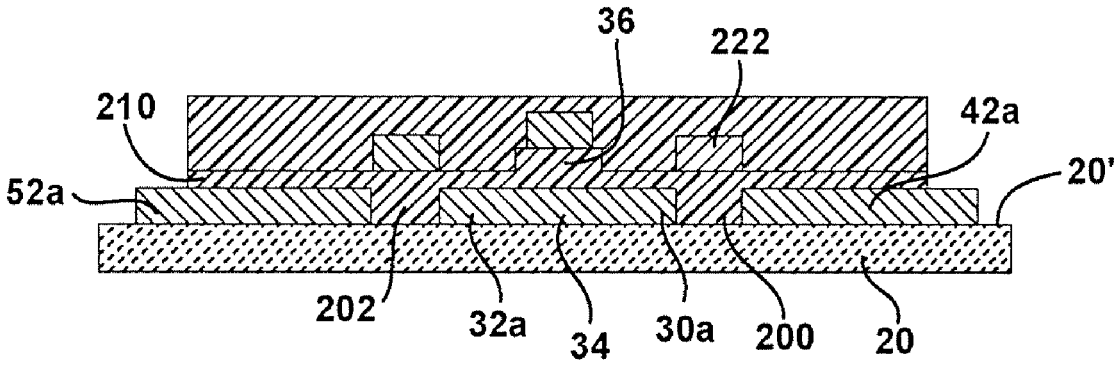
FIG. 10 is a sectional view taken along the line 10-10 of FIG. 9.
Figure 11:
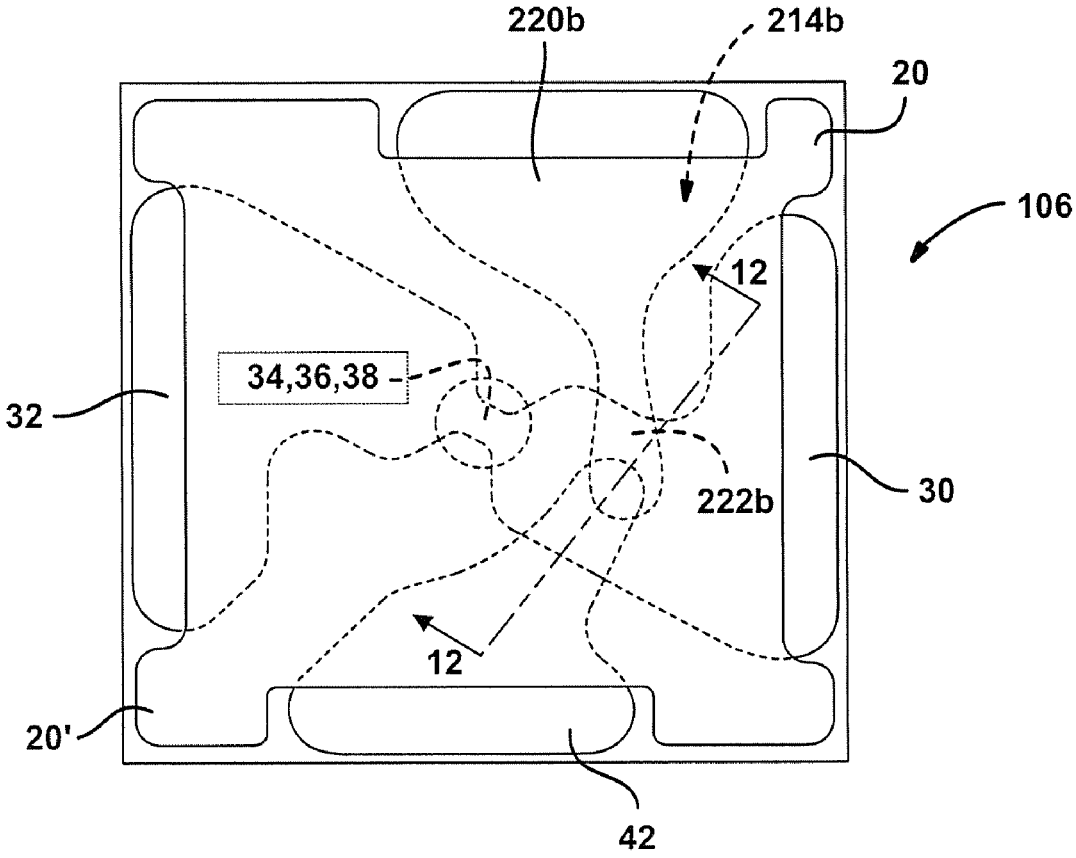
FIG. 11 is a top plan view of a third initiator constructed in accordance with the teachings of the present disclosure.
Figure 12:
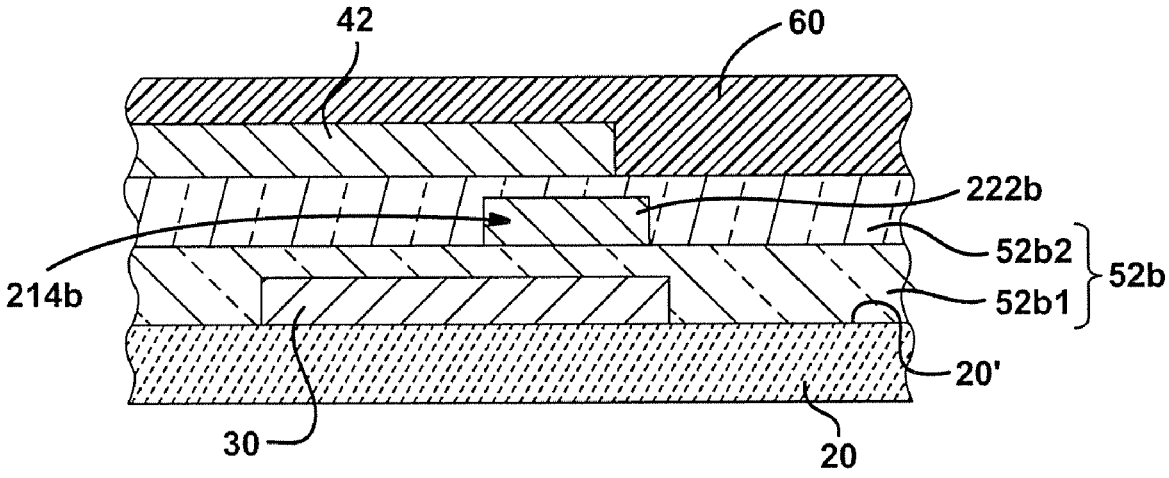
FIG. 12 is a sectional view taken along the line 12-12 of FIG. 11.

With reference to FIGS. 10 and 11, a third initiator constructed in accordance with the teachings of the present disclosure is generally indicated by reference numeral 10*b*. The initiator 10*b* can be generally similar to the initiator 10 of FIG. 1 except that a trigger contact 214*b* has been substituted for the second switch 28 (FIG. 2). The trigger contact 214*b* can be formed of a conductive material, such as but not limited to nickel, copper, gold, silver, aluminum and alloys thereof, and can be formed by one or more discrete layers conductive material. The trigger contact 214*b* can be disposed vertically between two or more discrete layers (52*b*1, 52*b*2) of insulating material 52*b* between the first bridge contact 30 and the first switch terminal 42. The trigger contact 214*b* can include a terminal portion 220*b*, which can be adapted to be coupled to a source of electrical energy (not shown) and a projection 222*b*. The projection 222*b* can extend from the terminal portion 220*b* and can be disposed vertically between the first bridge contact 30 and the first switch terminal 42. In the particular example provided, the first bridge contact 30 is coupled to the surface 20' of the substrate 20, a first layer of insulating material 52*b*1 is deposited over the first bridge contact 30, the trigger contact 214*b* is coupled to the first layer of insulating material 52*b*1 on a side opposite the first bridge contact 30, a second layer of insulating material 52*b*2 is deposited over the projection 222*b* of the trigger contact 214*b*, the first switch terminal 42 is coupled to the second layer of insulating material 52*b*2 and a third layer of insulating material 60 is deposited onto a portion of the first switch terminal 42.

The initiator 10*b* can be employed in a standard mode, a breakdown mode or a trigger mode. Operation of the initiator 10*b* in the standard and breakdown modes can be generally similar to the operation of the initiator 10 (FIG. 1) in these modes and as such, need not be discussed in further detail. Operation of the initiator 10*b* in the trigger mode can include electrically coupling the second bridge contact 32 to an electrical ground, electrically coupling the first switch terminal 42 to a source of electric power having an electric potential that is not sufficient (by itself to transmit electric energy through the insulating material 52*b* (i.e., vertically through the first and second layers of insulating material 52*b*1 and 52*b*2 to the first bridge contact 30) and selectively coupling the terminal portion 220*b* of the trigger contact 214*b* to a voltage source, such as a negative voltage source. Application of electric power to the terminal portion 220*b* can affect the field between the first bridge contact 30 and the first switch terminal 42 to effectively lower the electric potential that is necessary to cause energy to be transmitted through the insulating material 52*b* (i.e., so that the electric potential of the energy applied to the first switch terminal 42 is sufficient to transmit electric energy through the insulating material 52*b* to the first bridge contact 30). As will be appreciated, electrical energy that is received by the first bridge contact 30 can be transmitted through the bridge 34 and the second bridge contact 32 as described above.

While specific examples have been described in the specification and illustrated in the drawings, it will be understood by those of ordinary skill in the art that various changes may be made and equivalents may be substituted for elements thereof without departing from the scope of the present disclosure as defined in the claims. Furthermore, the mixing and matching of features, elements and/or functions between various examples is expressly contemplated herein so that one of ordinary skill in the art would appreciate from this disclosure that features, elements and/or functions of one example may be incorporated into another example as appropriate, unless described otherwise, above. Moreover, many modifications may be made to adapt a particular situation or material to the teachings of the present disclosure without departing from the essential scope thereof. Therefore, it is intended that the present disclosure not be limited to the particular examples illustrated by the drawings and described in the specification as the best mode presently contemplated for carrying out this invention, but that the scope of the present disclosure will include any embodiments falling within the foregoing description and the appended claims.

What is claimed is:

1. An initiator comprising:

a substrate having a surface;

an exploding foil initiator coupled to the substrate, the exploding foil initiator including a conductive bridge and a first bridge contact; and a first switch having a first terminal and a first insulator, the first terminal coupled to the substrate and being spaced apart from the first bridge contact by a gap, the first insulator being disposed in the gap and being coupled to the first terminal and the bridge contact;

wherein the first switch is operable in an actuated mode in which electrical energy transmitted between the first terminal and the first bridge contact is transmitted through the first insulator.

2. The initiator of claim 1, wherein the surface defines a plane and the gap is disposed in a direction that is perpendicular to the plane.

3. The initiator of claim 2, further comprising a trigger element that is at least partially formed of a conductive material, the trigger element being disposed between the first bridge contact and the first terminal and insulated therefrom by the first insulator.

4. The initiator of claim 1, wherein the exploding foil initiator is mounted directly onto the substrate.

5. The initiator of claim 4, wherein first terminal is mounted directly onto the substrate.

6. The initiator of claim 1, wherein the exploding foil initiator includes a flyer and wherein the flyer is at least partially formed of the first insulator.

7. The initiator of claim 1, wherein the exploding foil initiator includes a second bridge contact and the initiator further comprises a second switch having a second contact and a second insulator, the second contact coupled to the substrate and being spaced apart from the second bridge contact by a second gap, the second insulator being disposed in the second gap;

wherein the second switch is operable in an actuated mode in which electrical energy transmitted between the second contact and the second bridge contact is transmitted through the second insulator.

8. The initiator of claim 7, wherein second contact is mounted directly onto the substrate.

9. The initiator of claim 1, wherein the first insulator is formed at least partially of polyimide.

10. A method comprising:

providing an initiator having an exploding foil initiator and a first switch, the exploding foil initiator including a substrate and a bridge, the bridge being coupled to the substrate and including a first bridge contact, the switch including a first terminal, which is spaced apart from the first bridge contact by a predetermined distance, and a first insulator that is received in the first gap, the first insulator being coupled to the substrate between the first bridge contact and the first terminal;

applying electrical energy to the first terminal; and directing electrical energy from the first terminal through the first insulator to the first bridge contact to thereby actuate the exploding foil initiator.

11. The method of claim 10, wherein the substrate defines a plane and wherein the electrical energy is transmitted in a direction that intersects the plane when the exploding foil initiator is actuated.

12. The method of claim 11, wherein directing electrical energy comprises:

coupling a trigger element to the substrate between the first bridge contact and the first terminal; and applying electrical energy to the trigger element prior to initiate a flow of electrical energy between the first terminal and the first bridge contact.

13. An initiator comprising:

an exploding foil initiator having a bridge and a first bridge contact that are disposed in a first layer;

a first switch terminal disposed in a second layer that is parallel to the first layer; and an insulating material that is disposed between the first and second layers;

wherein at least a portion of the first switch terminal overlies the first bridge contact.

14. The initiator of claim 13, further comprising a trigger element that is disposed in a third layer between the first and second layers.

15. The initiator of claim 14, wherein the exploding foil initiator includes a second bridge contact that is disposed in the first layer.

16. The initiator of claim 15, further comprising a second switch terminal that is offset from the second bridge contact.

17. The initiator of claim 16, further comprising a second trigger element that is disposed between the second bridge contact and the second switch terminal.

18. The initiator of claim 13, wherein the exploding foil initiator includes a flyer that is at least partially formed of the first insulator.

19. The initiator of claim 13, further comprising a second bridge contact that is disposed in the first layer.

20. The initiator of claim 19, further comprising a second switch terminal that is spaced apart from and at least partially overlies the second bridge contact.

* * * * *

UNITED STATES PATENT AND TRADEMARK OFFICE

CERTIFICATE OF CORRECTION

PATENT NO. : 7,581,496 B2
APPLICATION NO. : 11/828032
DATED : September 1, 2009
INVENTOR(S) : George N. Hennings et al.

It is certified that error appears in the above-identified patent and that said Letters Patent is hereby corrected as shown below:

In The Specification,

Column 1, lines 3-4 After the "TITLE OF THE INVENTION" and before "CROSS-REFERENCE TO RELATED APPLICATIONS" insert

--STATEMENT REGARDING FEDERALLY SPONSORED RESEARCH AND DEVELOPMENT

This invention was made with Government support under N68936-05-D-0030, awarded by the Naval Air Warfare Center Weapons Division.--, therefor.

Signed and Sealed this
Seventeenth Day of May, 2016

Michelle K. Lee

Michelle K. Lee
*Director of the United States Patent and Trademark Office*